United States Patent [19]

Ohtomo

[11] 4,225,097

[45] Sep. 30, 1980

[54] FILM CARRYING ROLLER

[76] Inventor: Ryuji Ohtomo, 1691, 2 chome, Ikebukuro, Toshimaku, Tokyo 171, Japan

[21] Appl. No.: 62,575

[22] Filed: Jul. 31, 1979

Related U.S. Application Data

[63] Continuation of Ser. No. 704,617, Jul. 12, 1976, abandoned.

[30] Foreign Application Priority Data

Apr. 8, 1976 [JP] Japan ..... 51-42667

[51] Int. Cl.[3] ..... B65H 75/20

[52] U.S. Cl. ..... 242/55.01; 226/119; 226/190

[58] Field of Search ..... 242/55.01, 76; 226/190, 226/191, 189, 118, 119, 193, 186; 354/322, 319, 312, 313, 316, 297, 318; 352/80

[56] References Cited

U.S. PATENT DOCUMENTS

| | | | |
|---|---|---|---|
| 3,132,785 | 5/1964 | Kunz | 226/186 X |
| 3,330,460 | 7/1967 | Wick | 226/190 X |
| 3,446,410 | 5/1969 | Brose | 226/191 |
| 3,524,607 | 8/1970 | Furst | 226/191 X |
| 3,645,432 | 2/1972 | French | 226/190 |

*Primary Examiner*—George F. Mautz

*Attorney, Agent, or Firm*—Wenderoth, Lind & Ponack

[57] ABSTRACT

A film carrying roller comprises an outer annular groove for receiving a film, and an annular recess formed at the central portion of the bottom of the groove. An annular elastic tire has an upper convex surface and fits in the recess. Two annular inclined surfaces form remaining portions of the groove bottom, each of the inclined surfaces ascending from a respective upper annular edge of the recess to a respective outer annular end of the groove bottom. Such ends are positioned higher than the peak of the convex surface of the tire.

4 Claims, 5 Drawing Figures

FILM CARRYING ROLLER

This is a continuation of application Ser. No. 704,617, filed July 12, 1976, now abandoned.

BACKGROUND OF THE INVENTION

The present invention relates to a film carrying roller, and particularly, to a film carrying roller which can be used for carrying two films of different sizes, for example 16 mm and 8 mm films.

Hitherto, as a roller for carrying two films of different sizes, a roller having an outer annular groove, both the inner walls of which are provided with two annular steps for receiving the two films, is known, but such roller cannot be used for driving a connected film consisting of such two films.

Further, a similar roller having an outer annular groove, and an annular soft rubber tire provided with a great many small projections on its upper surface and fit within the groove is known. This roller can drive the aforesaid connected film, but has various disadvantages to be described hereinafter.

SUMMARY OF THE INVENTION

It is a chief object of the invention to overcome such disadvantages and to provide a film carrying roller comprising an outer annular groove for receiving a film, an annular recess formed at the central portion of the bottom of the groove, an elastic tire having an upper convex surface, such tire fitting in the recess, and two annular slopes or inclined surfaces formed at both the remaining portions of the bottom of the groove, each such slope ascending from a respective upper annular edge of the recess to a respective outer annular end of the groove bottom, and each such end being positioned higher than the peak of the convex surface of the tire.

Further objects and advantages of the invention are as follows:

1. The aforesaid roller according to the invention can be effectively used for driving and guiding respectively two films of different sizes.

2. Such roller hardly gives any damage to the films, and particularly, to the picture and sound recording parts thereof.

3. Such roller is of comparatively simple construction, and can be supplied at a low cost.

BRIEF DESCRIPTION OF THE DRAWINGS

Other objects and advantages of the invention will be apparent from the following description, taken with the accompanying drawings, wherein.

DETAILED DESCRIPTION OF THE INVENTION

Figure 1:
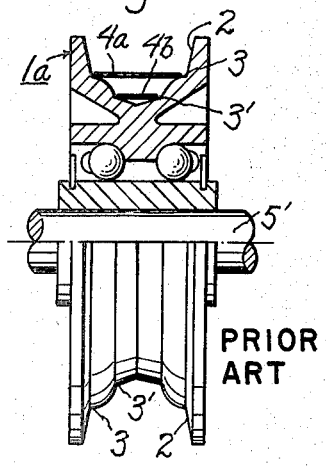
FIG. 1 is a half sectioned elevational view of a known film carrying roller, which is used for carrying two films of different sizes.

One known film carrying roller used for carrying two films of different sizes, is shown in FIG. 1. Roller 1*a* has an outer annular groove 2 for receiving films, both the inner walls of which groove are provided with two annular steps 3 and 3', and the two upper steps 3 serve to receive a film of a larger size, for example a 16 mm film 4*a*, while the two lower steps 3' serve to receive a film of a smaller size, for example an 8 mm film 4*b*.

When carrying a connected film consisting of the two films the roller 1*a* cannot be used as a driving roller 1 (FIG. 5) because the circumferential speeds at the upper steps 3 and the lower steps 3' are different, and therefore, such roller can be used only as a guide roller 1' (FIG. 5) in the above case.

Figure 5:
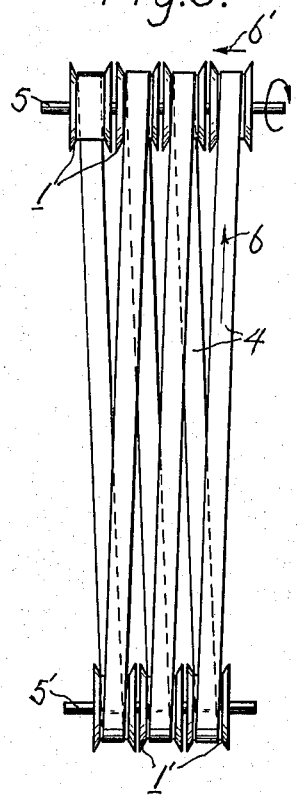
FIG. 5 is an elevational view of a series of driving rollers and a series of guide rollers, which are arranged up and down, a film being spirally wound therearound.

In an ordinary film processor, as shown in FIG. 5, a series of the driving rollers 1 are fixedly mounted on a driving shaft 5, while a series of the guide rollers 1' are rotatively mounted on a fixed shaft 5', and a film 4 is spirally wound or hung over the driving and guide rollers, and in this case the film runs in the direction indicated by a arrow 6.

Figure 2:
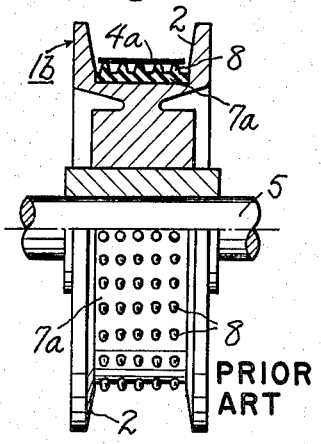
FIG. 2 is a view similar to FIG. 1 of another known film carrying roller.

Another known film carrying roller 1*b* is shown in FIG. 2. Roller 1*b* has the outer annular groove 2, and an annular soft rubber tire 7*a* provided with a great many small projections 8 on its upper surface fits in the bottom of the groove. Roller 1*b* can be used for driving and guiding even the aforesaid connected film, but dust, refuse and the like easily adhere to the many projections 8, and when adhered to such projections, the back of the film is soiled, and further, when the projections became uneven in height due to wear, the back of the film is damaged.

Such defects as above mentioned are not only overcome, but also several advantages are obtained by the invention as hereinafter described.

Figure 3:
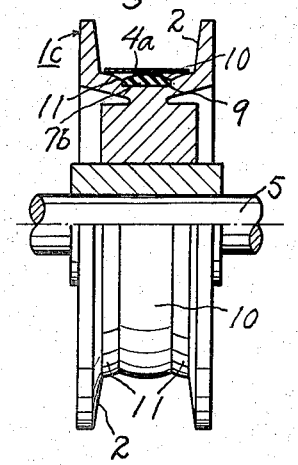
FIG. 3 is a view similar to FIG. 1, but of a film carrying roller according to the invention, which is used for carrying a 16 mm film.
Figure 4:
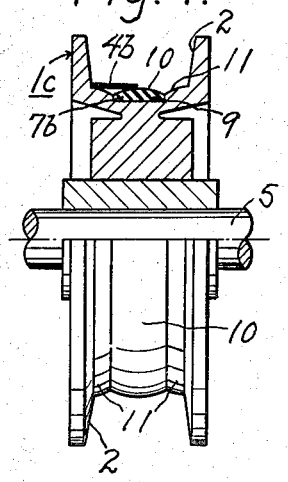
FIG. 4 is a view similar to FIG. 3, but of such roller used for carrying a 8 mm film.

The preferred embodiment of the invention is shown in FIGS. 3 and 4.

A film carrying roller 1*e* according to the invention has an outer annular groove 2 for receiving a film. An annular recess or indentation 9 is formed at the central portion of the bottom of groove 2, and an annular elastic tire 7*b*, for example of rubber, fits within the indentation 9, and an upper convex surface 10 of the tire projects upwardly therefrom. Formed at both the remaining portions of the bottom of groove 2 are annular slopes are inclined surfaces 11, each of which ascends from a respective upper annular edge of the indentation 9 to a respective outer annular end of the groove bottom, the outer end of each slope 11 being positioned higher than the peak of the convex surface 10 of the tire 7*b*.

The roller 1*c* is thus constructed, and its operation is as follows.

As shown in FIG. 3, the 16 mm film 4*a* of a larger size is received by both the end outer portions of the slopes 11 of the groove bottom, and then the film exists at such a high position as not to touch the convex surface 10 of the tire 7*b*.

The film 4*a* is driven by the roller 1*c* because of the friction between the side portions of the film and said the outer portions of the slopes 11, and the picture and sound recording parts of of the film suffer no damage.

Next, the 8 mm film 4*b* of a smaller size (FIG. 4) is first received by the convex surface 10 of the tire 7*b*, and soon traverses in one direction due to the horizontal component of force of the torque of the driving shaft 5, thereby leaning or drifting to one of the inner walls of the groove 2. In the case of FIG. 5 such horizontal component of force as indicated by arrow 6' causes the film 4*b* to move to the left inner wall of the groove 2, as shown in FIG. 4.

Then the film 4*b* is received by one outer end portion of one slope 11 and the peak portion of the convex surface 10, and is driven by the roller 1*c* due to friction at the receiving portions. Therefore, the picture and sound recording parts of the film suffer no damage.

When driving a connected film consisting of two films of different sizes by the roller 1*c*, there is no difference between the circumferential speeds at each film receiving portion for the two films, as is easily seen from the above description, and therefore, the roller can be effectively used for driving connected films of different sizes.

Further, since the upper surface 10 of the tire 7*b* of the roller 1*c* is smooth and convex, dust, refuse and the like hardly adhere to such surface, and accordingly, the back of a film to be driven is not soiled and damaged.

Moreover, the roller 1*c* is of comparatively simple construction, and can be supplied at a low cost.

In the above description 16 mm and 8 mm films are exemplified as the two films of different sizes, but 35 mm and 16 mm films and the like can be also effectively carried by the roller 1*c* of corresponding sizes.

What I claim is:

1. A device for carrying connected films of different widths, said device comprising:

a roller having an outer periphery with an annular groove formed therein, said groove being defined by a groove bottom and by axially spaced side walls, and an annular recess formed at the axial central portion of said bottom of said groove, said recess being defined by first and second axially spaced, substantially radially extending end walls and by a substantially axially extending bottom wall;

an annular elastic tire positioned within said recess, said tire having a radially outer annular convex surface extending axially continuously from said first end wall of said recess to said second end wall of said recess; and said groove bottom further including inclined annular surfaces positioned on opposite axial sides of said recess, each said inclined annular surface extending radially and axially outwardly from a respective end wall of said recess and from a respective axial end of said convex surface of said tire to a respective side wall of said groove, the radially outermost portions of said inclined annular surface being positioned further radially outward than the radially outwardmost peak of said convex surface of said tire.

2. A process for driving an guiding a length of film having opposite edges and a central portion, said process comprising:

providing a roller carrying device including:

a roller having an outer periphery with an annular groove formed therein, said groove being defined by a groove bottom and by axially spaced side walls, and an annular recess formed at the axial central portion of said bottom of said groove, said recess being defined by first and second axially spaced, substantially radially extending end walls and by a substantially axially extending bottom wall;

an annular elastic tire positioned within said recess, said tire having a radially outer annular convex surface extending axially continuously from said first end wall of said recess to said second end wall of said recess; and said groove bottom further including inclined annular surfaces positioned on opposite axial sides of said recess, each said inclined annular surface extending radially and axially outwardly from a respective end wall of said recess and from a respective axial end of said convex surface of said tire to a respective side wall of said groove, the radially outermost portions of said inclined annular surfaces being positioned further radially outward than the radially outwardmost peak of said convex surface of said tire;

positioning said film within said groove in said roller with at least one of said edges of said film contacting one of said inclined annular surfaces of said roller, while preventing contact of said central portion of said film with any surface of said roller; and rotating said roller and thereby driving said film.

3. A process as claimed in claim 2, comprising positioning said film with both said edges thereof contacting respective said inclined annular surfaces of said roller and with said central portion of said film spaced radially outwardly from said convex surface of said tire.

4. A process as claimed in claim 2, comprising positioning a first said edge of said film contacting a respective one of said inclined annular surface of said roller, and positioning a second said edge of said film contacting said convex surface of said tire.

* * * * *